US009431772B2

(12) United States Patent
Gao et al.

(10) Patent No.: US 9,431,772 B2
(45) Date of Patent: Aug. 30, 2016

(54) CONNECTOR RETENTION FEATURES

(71) Applicant: Apple Inc., Cupertino, CA (US)

(72) Inventors: Zheng Gao, San Jose, CA (US); Mahmoud R. Amini, Sunnyvale, CA (US); Chia Chi Wu, Taipei (TW)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/578,290

(22) Filed: Dec. 19, 2014

(65) Prior Publication Data

US 2015/0214673 A1 Jul. 30, 2015

Related U.S. Application Data

(60) Provisional application No. 61/918,648, filed on Dec. 19, 2013, provisional application No. 61/922,856, filed on Jan. 1, 2014.

(51) Int. Cl.

| | |
|---|---|
| ***H01R 13/627*** | (2006.01) |
| ***H01R 13/6597*** | (2011.01) |
| ***H01R 24/60*** | (2011.01) |
| *H01R 107/00* | (2006.01) |

(52) U.S. Cl.

CPC ..... *H01R 13/6597* (2013.01); *H01R 13/6275* (2013.01); *H01R 24/60* (2013.01); *H01R 2107/00* (2013.01)

(58) Field of Classification Search

CPC ..... H01R 13/6597; H01R 13/6658; H01R 13/6275; H01R 13/6271; H01R 12/712; H01R 24/60

USPC ..... 439/352

See application file for complete search history.

(56) References Cited

U.S. PATENT DOCUMENTS 5,580,268 A * 12/1996 Miyazawa ..... H01R 13/6275 29/868
8,029,319 B2 * 10/2011 Kameyama ..... H01R 12/712 439/607.01
2005/0255736 A1 * 11/2005 Szczesny ..... H01R 13/6335 439/352
2006/0134962 A1 * 6/2006 Yeh ..... H01R 13/6271 439/352
2007/0293079 A1 * 12/2007 Chao ..... H01R 13/6275 439/352
2009/0042420 A1 * 2/2009 Zheng ..... H01R 13/6658 439/83
2009/0042448 A1 * 2/2009 He ..... H01R 23/6873 439/650
2009/0042450 A1 * 2/2009 Zheng ..... H01R 23/6873 439/660
2009/0142962 A1 * 6/2009 Zhang ..... H01R 13/5808 439/626
2009/0163071 A1 * 6/2009 Chen ..... H01R 13/65802 439/352
2009/0258539 A1 * 10/2009 Zheng ..... H01R 13/65802 439/607.41
2010/0055987 A1 * 3/2010 Zheng ..... H01R 24/62 439/660
2011/0124229 A1 * 5/2011 Li ..... H01R 12/724 439/626
2014/0370729 A1 * 12/2014 Wang ..... H01R 13/6471 439/108
2015/0079843 A1 * 3/2015 Nakashima ..... H01R 13/6585 439/607.09
2015/0229077 A1 * 8/2015 Little ..... H01R 13/6582 439/78

* cited by examiner

*Primary Examiner* — Jean F Duverne

(74) *Attorney, Agent, or Firm* — Kilpatrick Townsend & Stockton LLP

(57) ABSTRACT

Connector systems that may include improved locking and retention features. One example includes a connector plug having an opening to accept an end of a wide portion of a connector receptacle tongue. Another connector plug may include top and bottom rails for holding a wide portion of a connector receptacle tongue. The locking and retention features may provide a large locking force. Further examples may accordingly provide unlocking features.

23 Claims, 14 Drawing Sheets

CONNECTOR RETENTION FEATURES

CROSS-REFERENCES TO RELATED APPLICATIONS

This application is a nonprovisional of and claims priority to U.S. patent provisional application Nos. 61/918,648, filed Dec. 19, 2013, and 61/922,856, filed Jan. 1, 2014, which are incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices. Power may be transferred with this data, or power may be transferred separately.

Power and data may be conveyed over cables that may include wire conductors, fiber optic cables, or some combination of these or other conductors. Cable assemblies may include a connector insert at each end of a cable, though other cable assemblies may be connected or tethered to an electronic device in a dedicated manner. The connector inserts may be inserted into receptacles in the communicating electronic devices.

It may be desirable that a connector insert not accidently disconnect from a connector receptacle during device operation. For example, during a large data transfer, if a connector insert disconnects from a connector receptacle, the transfer may become corrupted. This may require a transfer restart thereby costing a user time and may diminish the user's opinion of the electronic devices involved.

Thus, what is needed are inserts, receptacles, and apparatus for connector systems that are at least less likely to become accidently or inadvertently disconnected.

SUMMARY

Accordingly, embodiments of the present invention may provide inserts, receptacles, and apparatus for connector systems that are at least less likely to become accidently or inadvertently disconnected.

An illustrative embodiment of the present invention may provide a first connector having one or more sides ground contacts having openings. These openings may be arranged to accept edges of a wide portion of a tongue on a second connector. During insertion, front edges of the side contacts may slide along outer edges of the wide portion of the tongue on the second connector. The opening in the side ground contact may have a front edge to engage an edge defining the wider portion of the tongue. The relative angle between these two surfaces and their relation to a direction of insertion of an insert into a receptacle may determine an amount of a retention force between two connectors. For instance, two flat surfaces facing each other, where the surfaces are orthogonal to a direction of insertion (or more specifically, extraction), may provide a robust locking feature, while more angled or slopped surfaces at other angles to the direction of insertion may provide retention forces that are more easily overcome.

Another illustrative embodiment of the present invention may provide a first connector having one or more side ground contacts formed from an upper and a lower rail. These upper and lower rails may include contacting portions at their ends that are arranged to hold a wide portion of a tongue on a second connector. In this example, during insertion, the upper and lower rail's contacting portions may slide across a top and bottom surface of the wide portion of the tongue. Facing edges of the wide portion of the tongue and contacting portions of the upper and lower rails may be angled relative to each other and to the direction of insertion (or extraction) in order to adjust an amount of retention force to a desired level.

In various embodiment of the present invention, it may be desirable to adjust a level of retention force provided by a retention mechanism. In various embodiment of the present invention, this may be done by adjusting an angle of contacting surfaces between one or more side contacts and a wider portion of a connector tongue both relative to each other and to a direction of insertion (or extraction.). For example, two opposing flat surfaces orthogonal to a direction of extraction may provide a high retention force in a robust locking mechanism. However, a user may inadvertently fail to release the locking mechanism and may attempt to pull the connectors apart. This force may damage either a side ground contact or a wide portion of a tongue in one or both of the connectors. Accordingly, one or both surfaces may be slightly angled to reduce the locking force to a level that prevents accidental disconnects while preventing damage when a large force is applied. In still other embodiments of the present invention, such as those employed in docking stations, only a slight retention force may be desirable so that a user does not pick up the docking station when extracting an electronic device, such as a phone or tablet device.

In various embodiments of the present invention, one or more side ground contacts may be located in either a connector insert or plug or a connector receptacle. The tongue may be included in either a connector receptacle or a connector insert or plug.

Further embodiments of the present invention may provide unlocking mechanisms to allow a user to remove the retention or locking force. Various embodiments of the present invention may provide unlocking mechanisms that may be actuated by one or more buttons on sides, top, or bottom of a connector insert.

Embodiments of the present invention may be used in connector inserts and receptacles for cables that may connect to various types of devices, such as portable computing devices, tablets, desktop computers, laptops, all-in-one computers, cell phones, smart phones, media phones, storage devices, portable media players, navigation systems, monitors, power supplies, adapters, and chargers, and other devices. These connector inserts may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
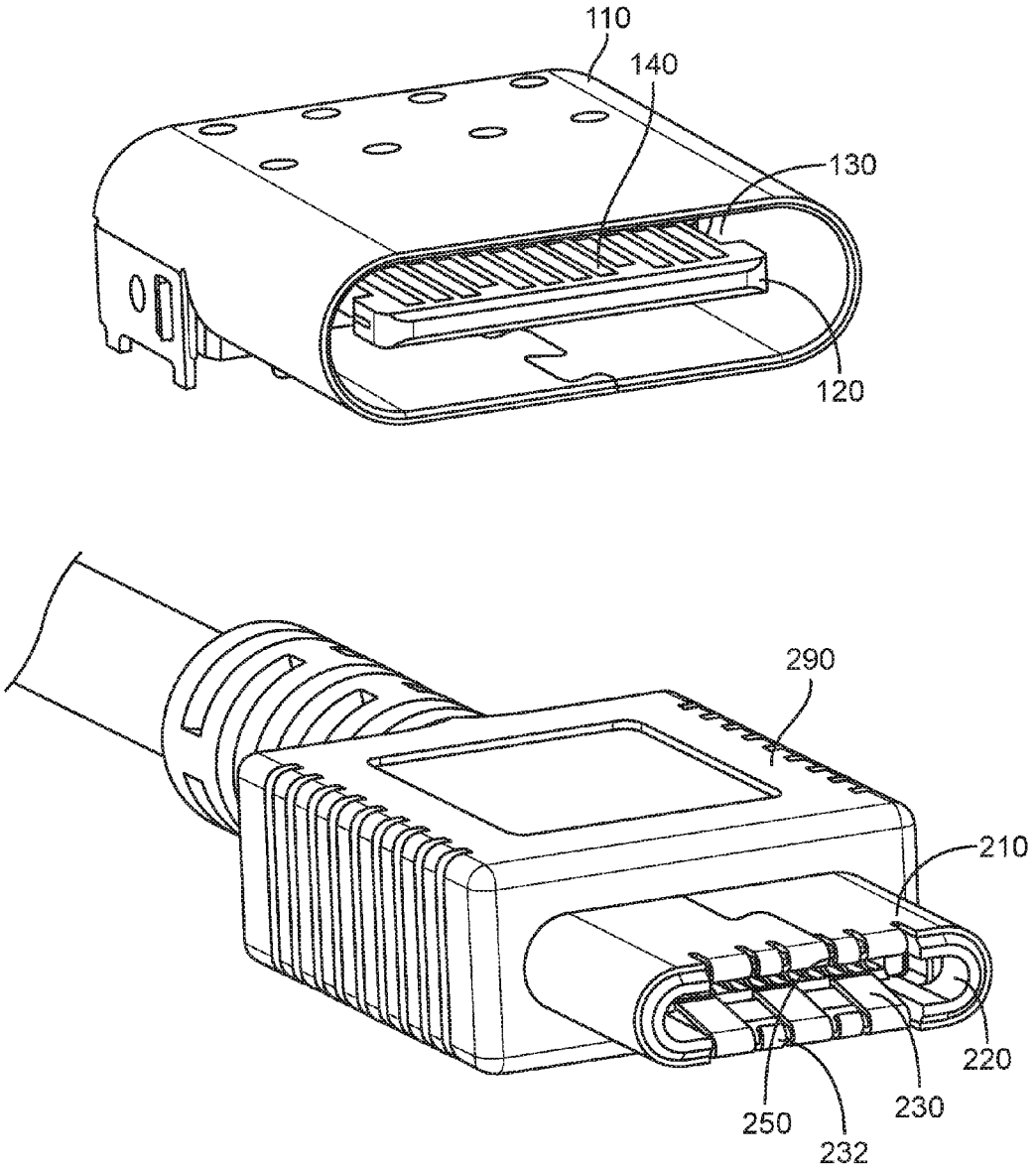
FIG. 1 illustrates a connector receptacle and insert according to an embodiment of the present invention.

FIG. 1 illustrates a connector receptacle and insert according to an embodiment of the present invention. This figure, as with the other included figures, is shown for illustrative purposes and does not limit either the possible embodiments of the present invention or the claims.

In this example, the connector insert may be inserted into the connector receptacle. Specifically, shield 210 of the connector insert may be inserted into shield 110 of connector receptacle. Tongue 120 may be inserted into an opening in the front of the connector insert. Contacts 250 of the connector insert may mate with contacts 140 in the connector receptacle. Contacts 230 of the connector insert may engage ground contacts (not shown) in the connector receptacle. Housing 290 may be grasped by a user during insertion and extraction of a connector insert into and out of the connector receptacle.

Figure 2:
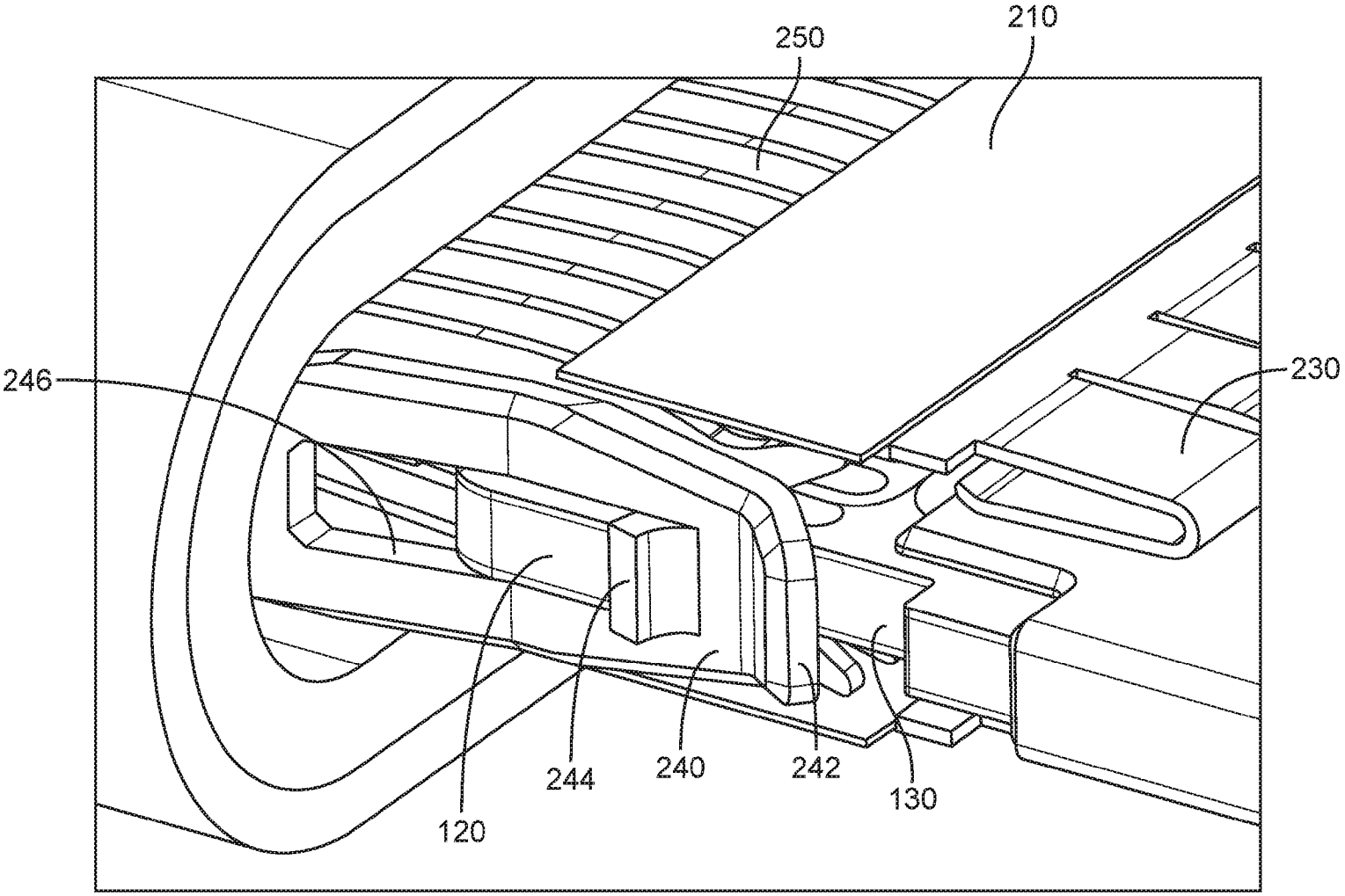
FIG. 2 illustrates a connector system retention mechanism according to an embodiment of the present invention.

FIG. 2 illustrates a connector system retention mechanism according to an embodiment of the present invention. In this example, one or two (or more) side ground contacts 240 may be located on a connector insert. Tongue 120 may be located in a connector receptacle and may have a wide portion formed by notch 130. More specifically, notch 130 may narrow the tongue defining a narrow portion, leaving a wider portion to support contacts 140. A first end of this wide portion of tongue 120 may fit in openings 246 of side ground contact 240. Side ground contact 240 may have a leading edge 242 angled away from connector insert contacts 250. Side ground contact 240 may further have an angled tab 244 at a front of opening 246. In this example, shield 210 of the connector insert may include one or more contacts 230 to form electrical contact with one or more ground pads on tongue 120.

During insertion, leading edge 242 of side ground contact 240 may engage the wide portion of tongue 120. This may cause side ground contact 240 to deflect. When leading edge 242 reaches notch 130, side ground contact 240 may return to its position thereby holding an edge of the wide portion of tongue 120 in opening 246. During extraction, tab 244 may cause side ground contact 240 to again deflect, thereby releasing the tongue.

Figure 3:
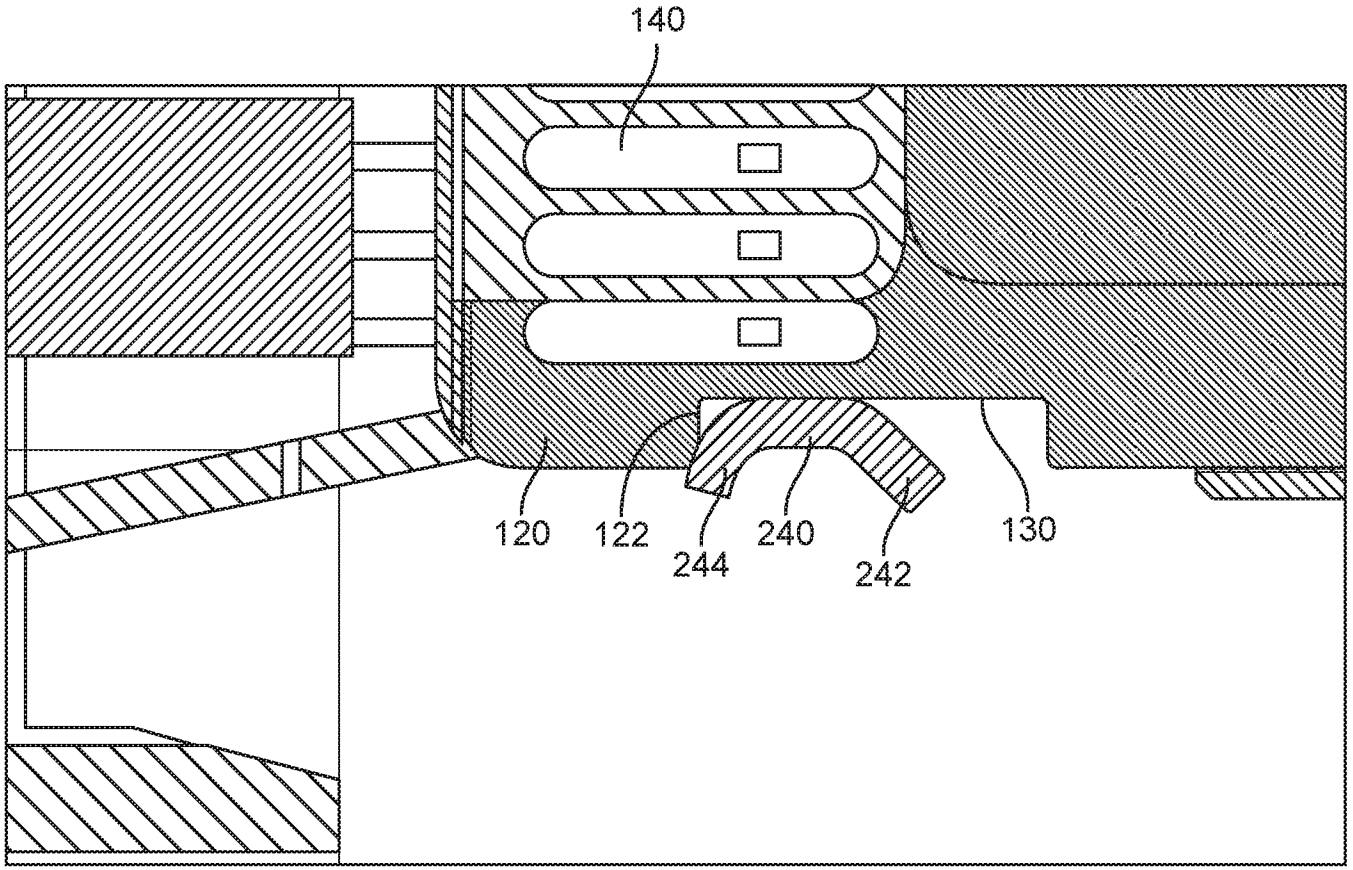
FIG. 3 illustrates a top view of the connector system retention mechanism of FIG. 2.

FIG. 3 illustrates a top view of the connector system retention mechanism of FIG. 2. Again, tongue 120 may have a wider portion defined by a notch 130. Side ground contact 240 may include an angled leading edge 242 and an angled trailing edge 244. The angled trailing edge 244 may be located in a front of an opening in the side ground contact 240.

Again, an angle between a face of trailing edge 244 and tongue edge 122 relative to a direction of extraction may determine the amount of retention force provided by this mechanism. To provide a high retention or lock force, edge 244 may be made flat. An example is shown in the following figure.

Figure 4:
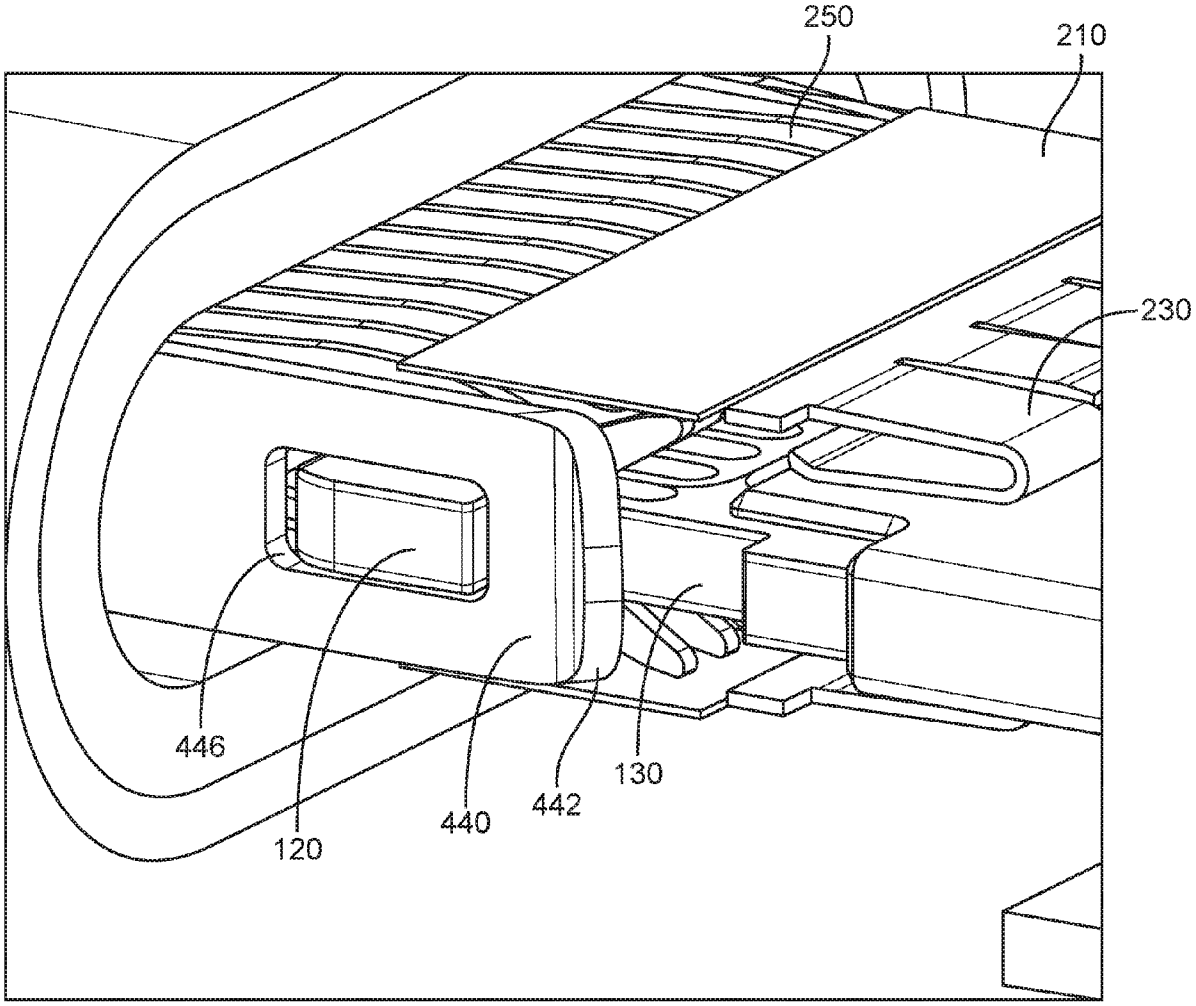
FIG. 4 illustrates another connector system retention mechanism according to an embodiment of the present invention.

FIG. 4 illustrates another connector system retention mechanism according to an embodiment of the present invention. In this example, one or two side ground contacts 440 may include an opening 446 for accepting an end of a wide portion of a tongue 120. As before, a leading edge 442 may be angled. The amount of this angle may provide a resistance to user inserting a connector insert into a connector receptacle. This leading edge may also pass along an outside edge surface of the wide portion of tongue 120 during insertion.

Again, during insertion, leading edge 442 may deflect when it encounters tongue 120. When leading edge 442 reaches notch 130, side ground contact 440 may return to its pre-biased state and hold an edge of the wide portion of tongue 120 in opening 446.

Figure 5:
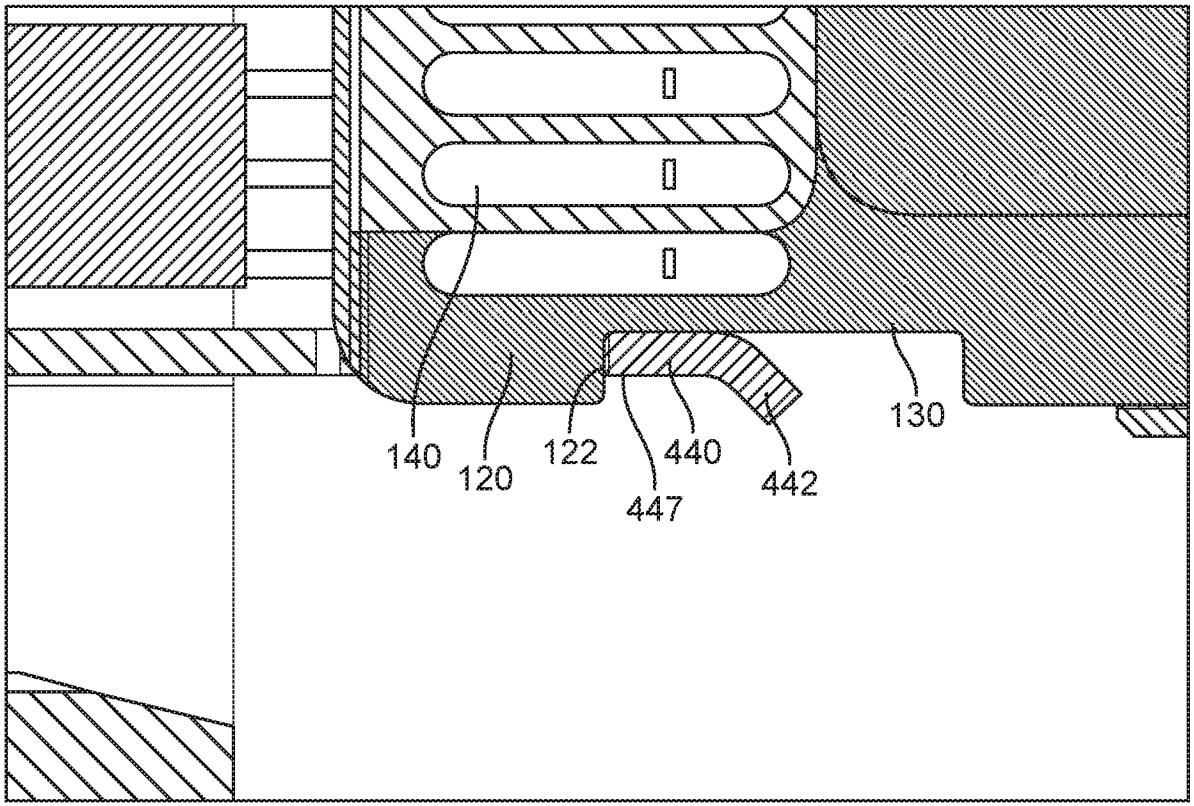
FIG. 5 illustrates a top view of the connector system retention mechanism of FIG. 4.

FIG. 5 illustrates a top view of the connector system retention mechanism of FIG. 4. Again, side ground contacts 440 may include an angel to leading portion 442. A wide portion of tongue 120 may be formed by notch 130. More specifically, notch 130 may form a narrow portion of tongue 120, forming a wider portion of tongue 120 in front of it toward the connector insert. Opposing faces 122 of tongue 120 and 447 of side ground contacts 440 may be relatively flat and orthogonal to the direction of extraction. This may in turn cause a large retention force, which may be referred to as a locking force.

Figure 6:
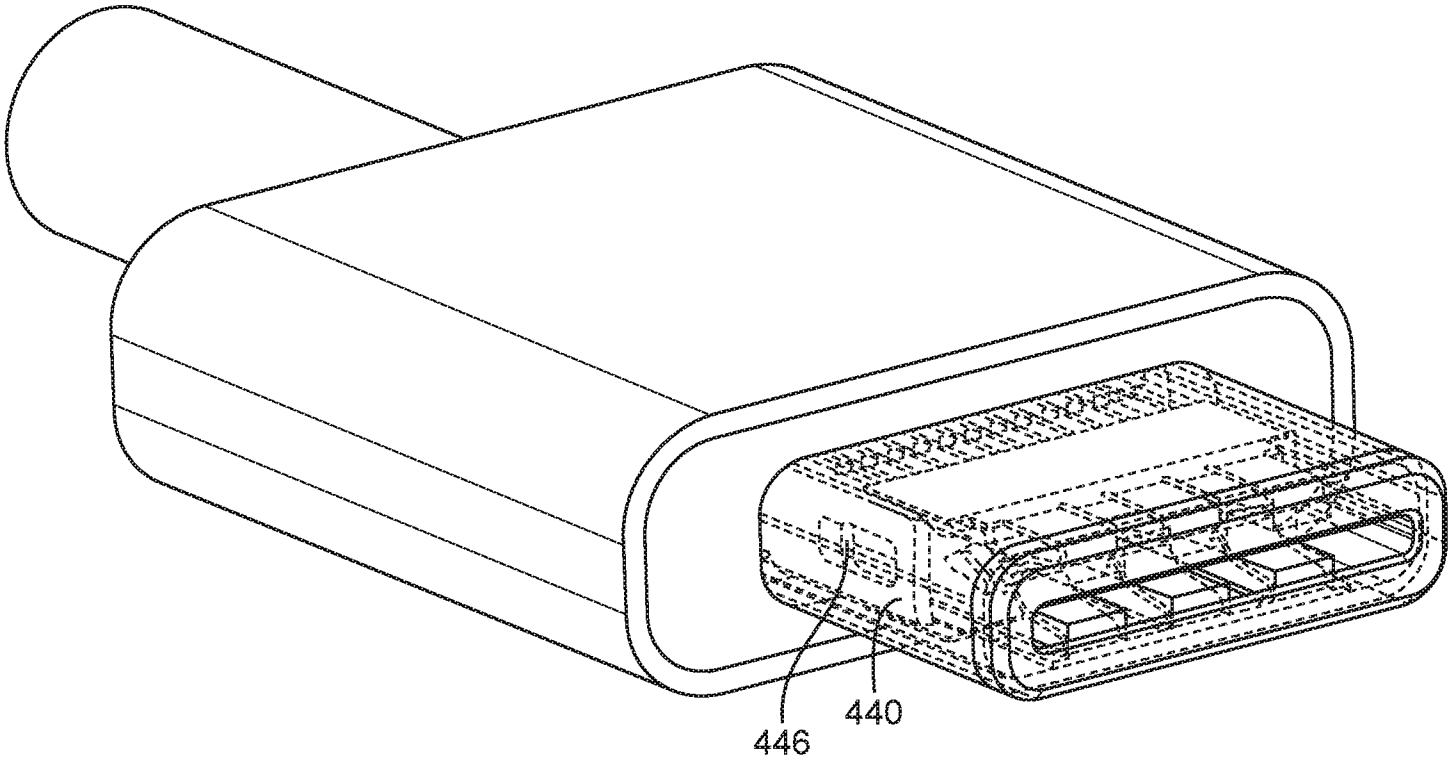
FIG. 6 illustrates an oblique view of a connector insert that includes the connector system retention mechanism of FIG. 4.

FIG. 6 illustrates an oblique view of a connector insert that includes the connector system retention mechanism of FIG. 4. Specifically, one or more sides ground contacts 440 having opening 446 may be included.

Again, the arrangement in FIG. 4 may provide a very high retention or locking force. In order to remove such a connector insert from a connector receptacle, the side ground contacts 440 may be moved away from tongue 120 and such that the side ground contact disengages the wide part of the tongue. Examples of unlocking mechanisms that may be employed by embodiments of the present invention are shown in the following figures.

Figure 7:
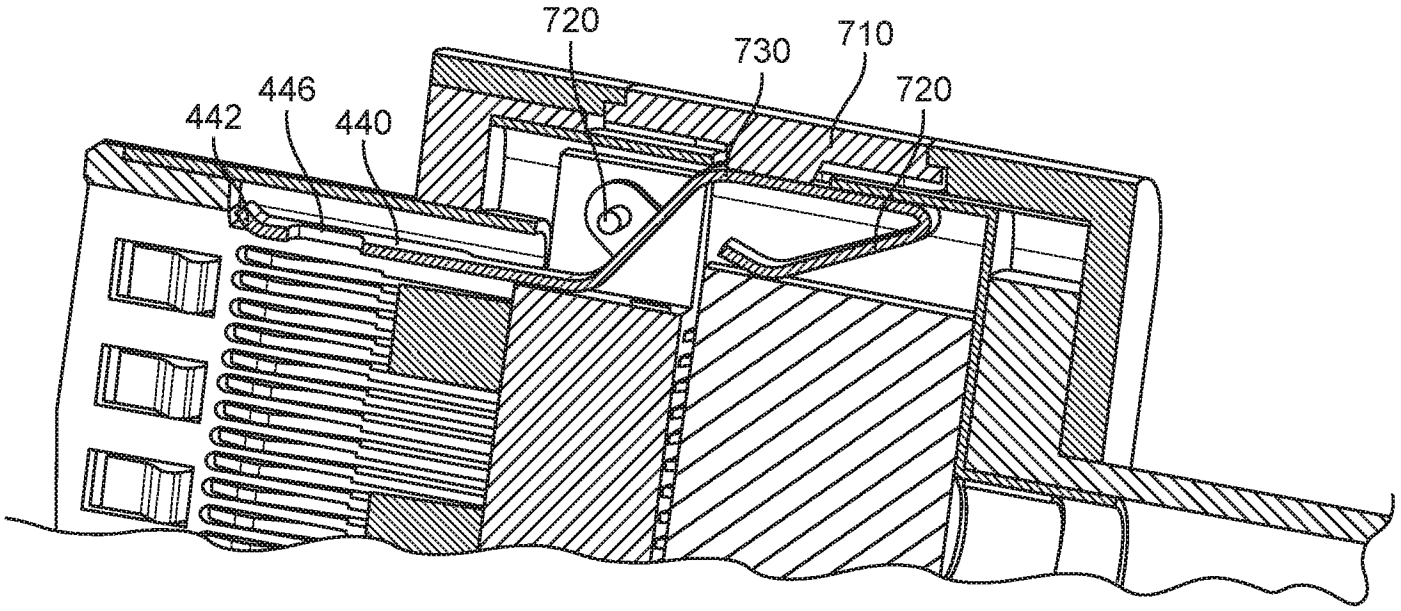
FIG. 7 illustrates an unlocking mechanism that may be employed by embodiment of the present invention.

FIG. 7 illustrates an unlocking mechanism that may be employed by an embodiment of the present invention. The unlocking mechanism may include a button 710 that may be depressed by a user when removing a connector insert from a connector receptacle. A depressing force on button 710 may cause ground contact portion 730 to be pushed toward the inside of the connector insert. This may, in turn, pivot side ground contact 440 around point 720, thereby pushing opening 446 away from tongue 120. When the user releases button 710, side ground contact portion 720 may actively return button 720 to its initial position and may further move side ground contact portion 442 towards an inside of the connector insert.

Figure 8:
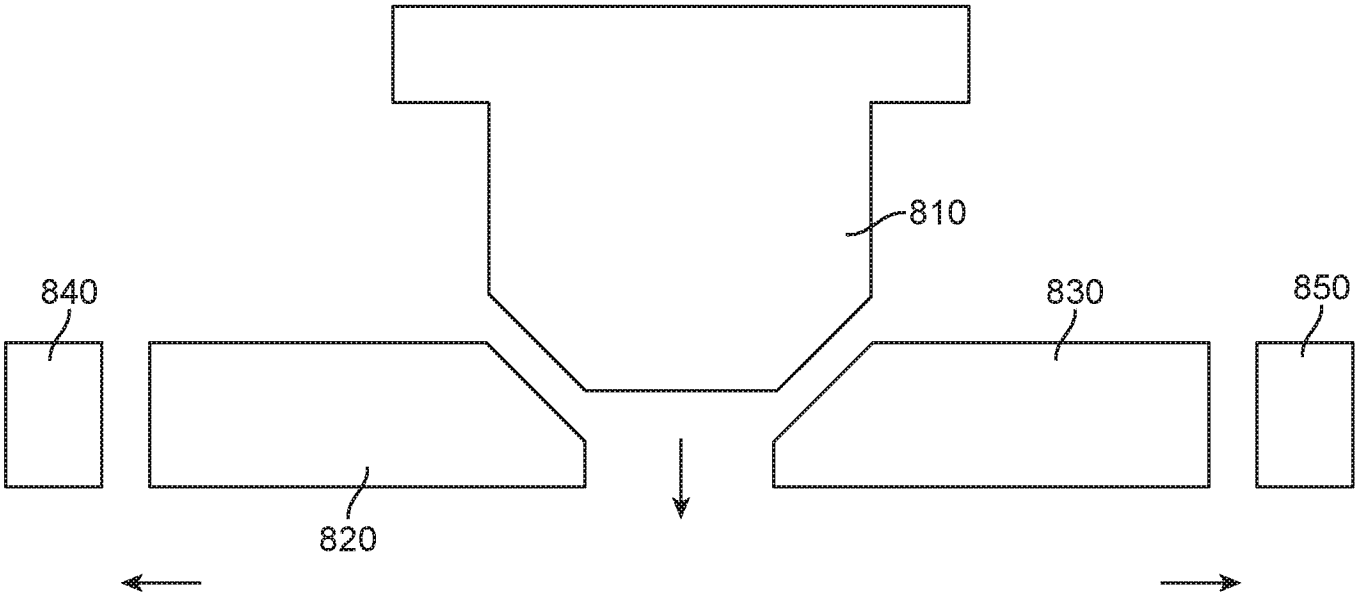
FIGS. 8-9 illustrate another unlocking mechanism according to an embodiment of the present invention.
Figure 9:
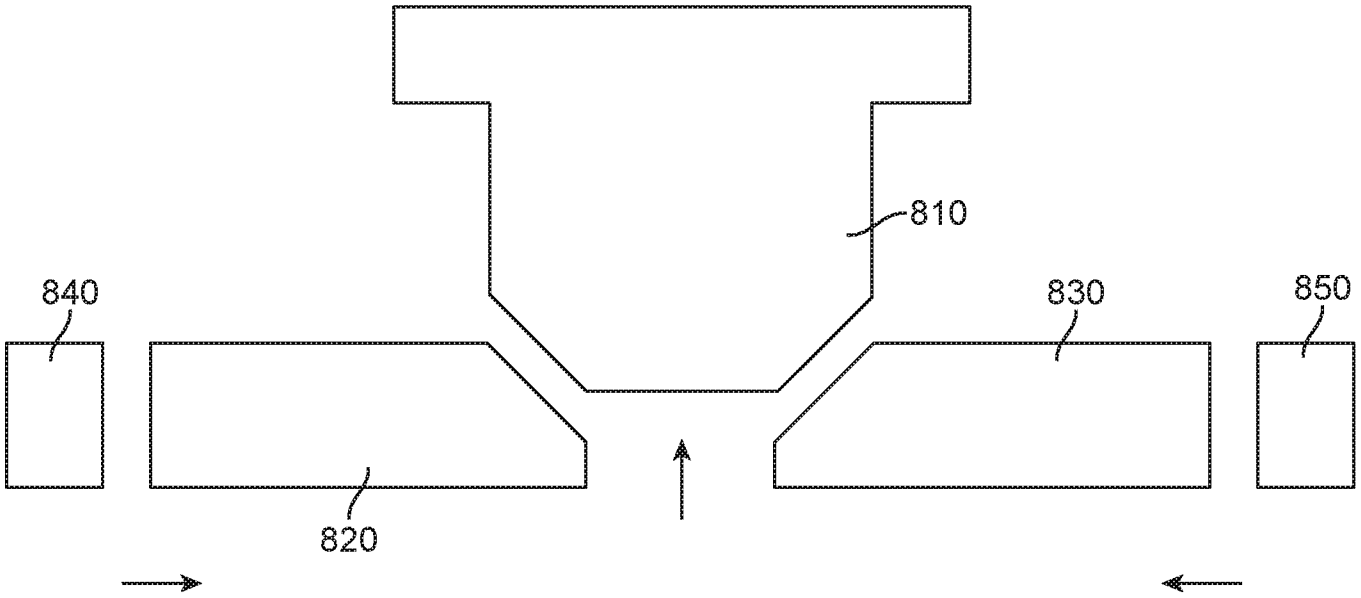

FIGS. 8-9 illustrate another unlocking mechanism according to an embodiment of the present invention. In this example, button 810 may be depressed in a downward direction as shown, pushing aside elements 820 and 830. This may push side ground contact portions 840 and 850 away from a tongue 120. As shown in FIG. 9, when button 810 is released, side ground contacts 840 and 850 may return to their original pre-biased positions, thereby pushing elements 820 and 830 closer to each other and returning button 810 to its original position.

Figure 10:
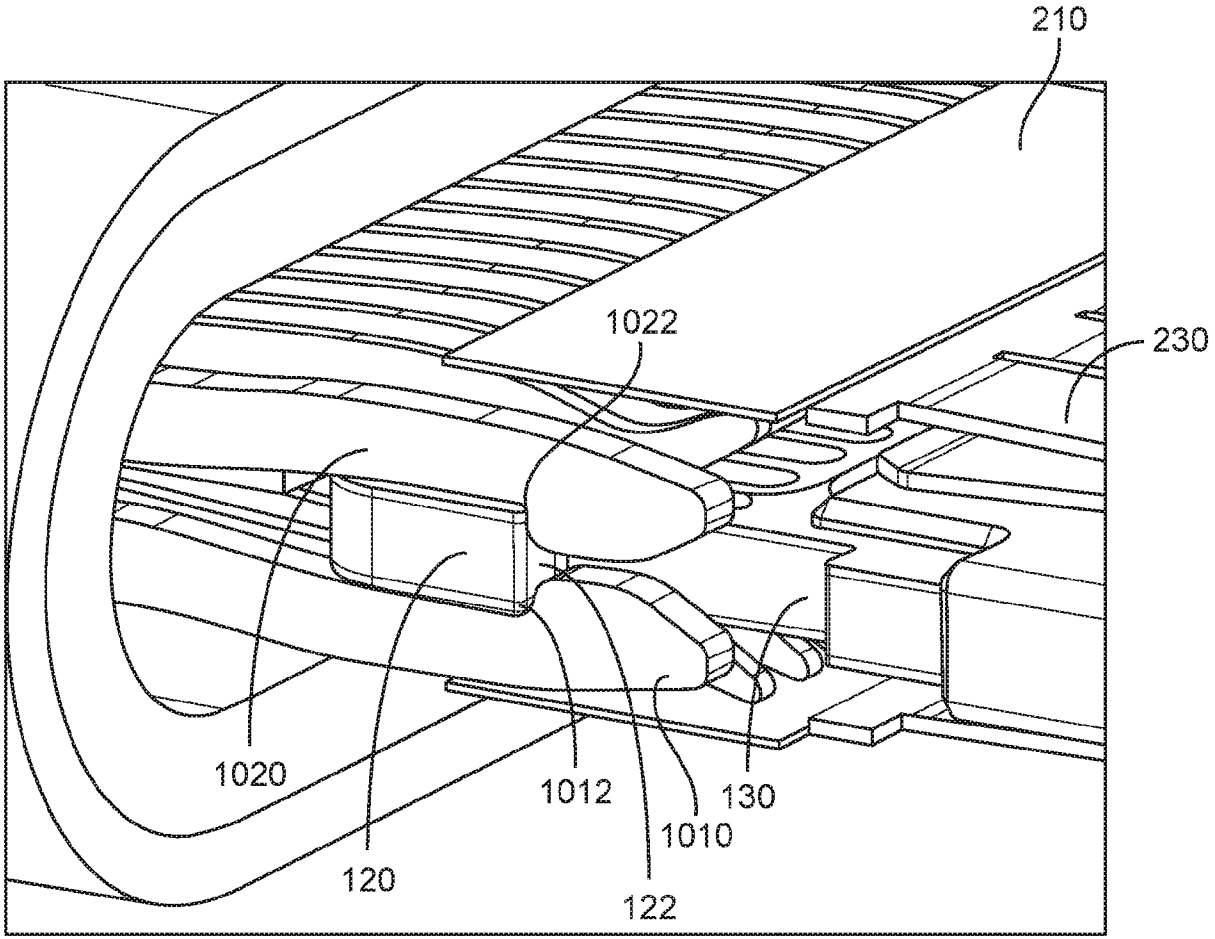
FIG. 10 illustrates another connector system retention mechanism according to an embodiment of the present invention.

FIG. 10 illustrates another connector system retention mechanism according to an embodiment of the present invention. In this example, a top rail 1020 and a bottom rail 1010 of a side ground contact may be arranged to hold a wide portion of tongue 120. As before, the wide portion of tongue 120 may be defined by notch 130. More specifically, the relative angles of faces 1012, 1022, and 122 may determine a retention or locking force provided. As with the other examples, a similar side ground contact may be provided at a far end of tongue 120 and is not shown here for clarity.

During insertion, upper and lower rails may deflect away from each other when they encounter tongue 120. The rails may then slide along a top and bottom of tongue 120. When contacting ends of the rails 1010 and 1020 reach notch 130, they may return to their pre-biased state and hold the wide end of tongue 120.

Figure 11:
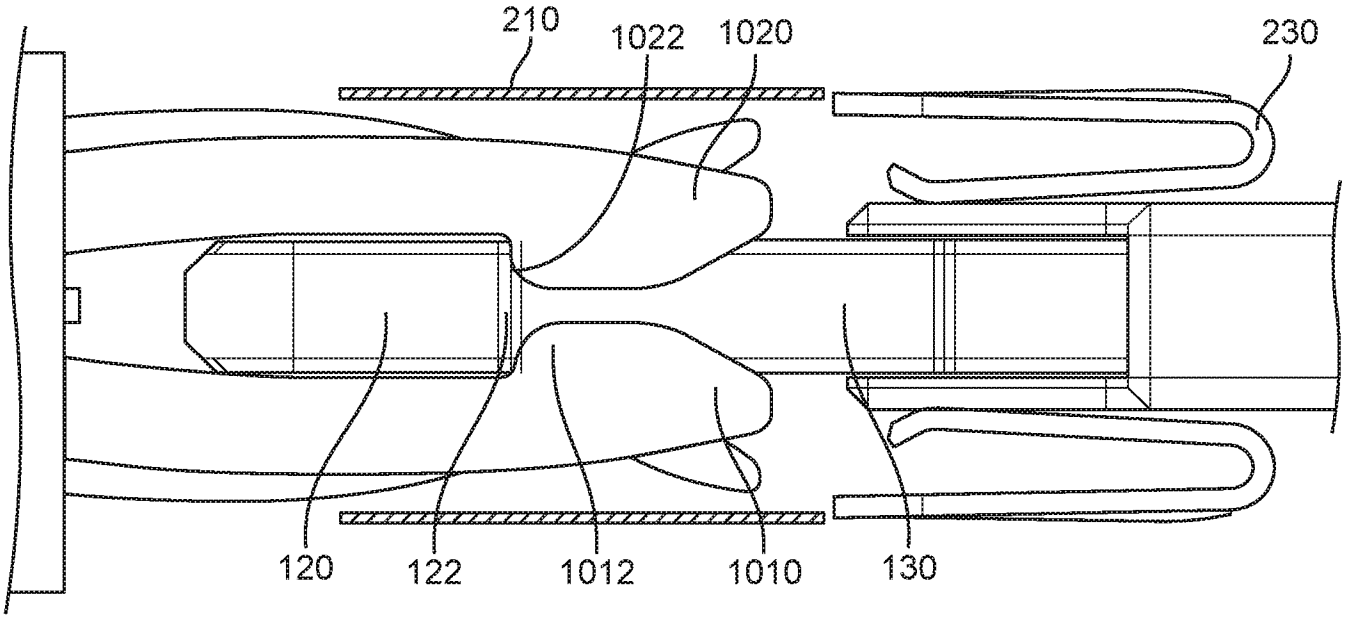
FIG. 11 illustrates a side view of a connector system retention mechanism of FIG. 10.

FIG. 11 illustrates a side view of a connector system retention mechanism of FIG. 10. As before, a side ground contact may include a top rail 1020 and a bottom rail 1010. These rails may include contacting portions arranged to hold a wide portion of tongue 120. Again, both the relative of angles of faces 1012, 1022, and 122 to each other and to the direction of extraction may be adjusted to provide a desired retention or locking force.

In this example, the rails of the side ground contacts may engage tongue 120 at approximately the same time during insertion as the remaining contacts of the connector insert. This may provide a smooth tactile response to user during insertion of a connector insert into a connector receptacle.

Figure 12:
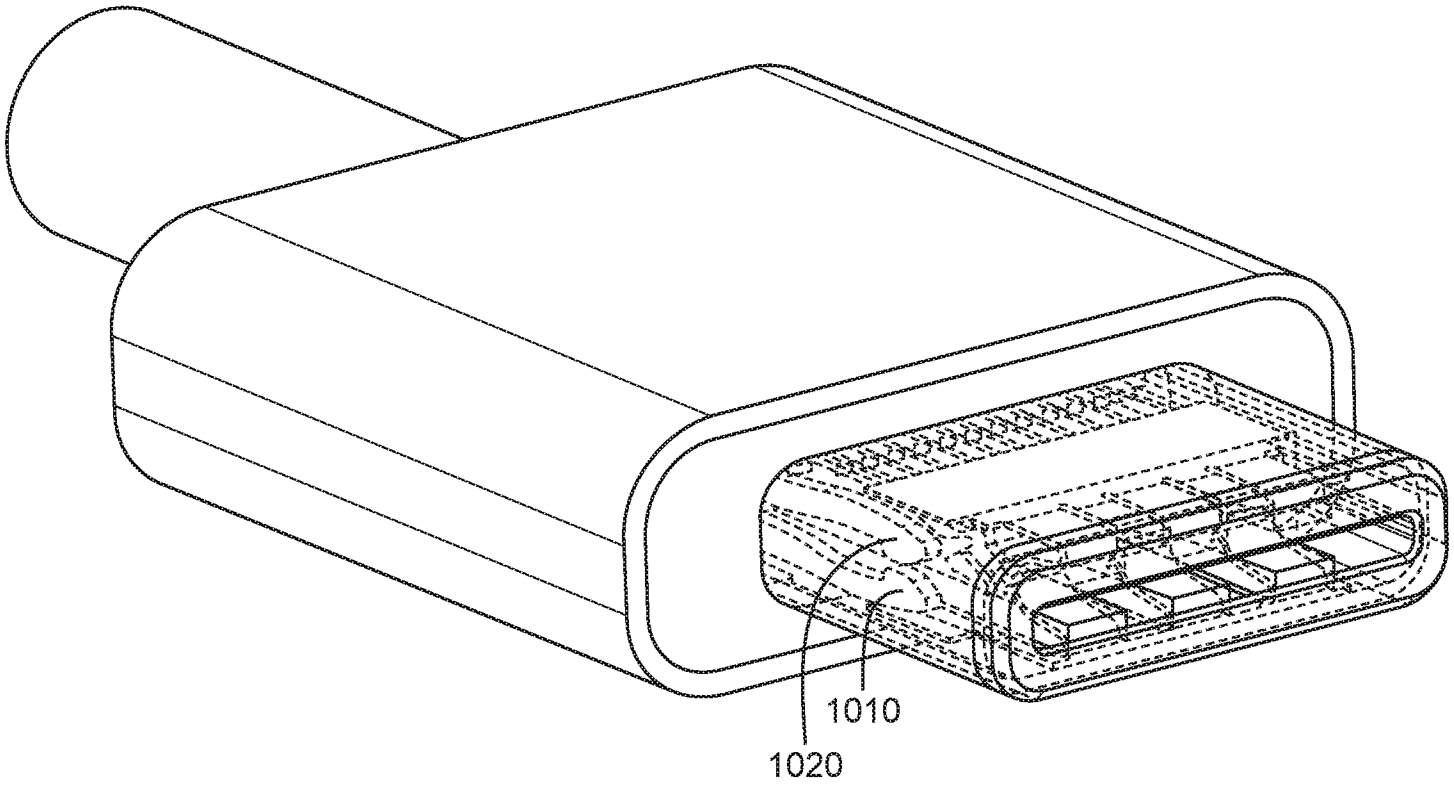
FIG. 12 illustrates an oblique view of a connector insert employing in the connector system retention mechanism of FIG. 10.

FIG. 12 illustrates an oblique view of a connector insert employing in the connector system retention mechanism of FIG. 10. Specifically, a side ground contact may include an upper rail 1020 and a lower rail 1010.

Again, the connector system retention mechanism of FIG. 10 may provide a large locking force. Accordingly, embodiments of the present invention may provide an unlocking mechanism to unlock the connector insert and receptacle during extraction. An example of such an unlocking mechanism is shown in the following figure.

Figure 13:
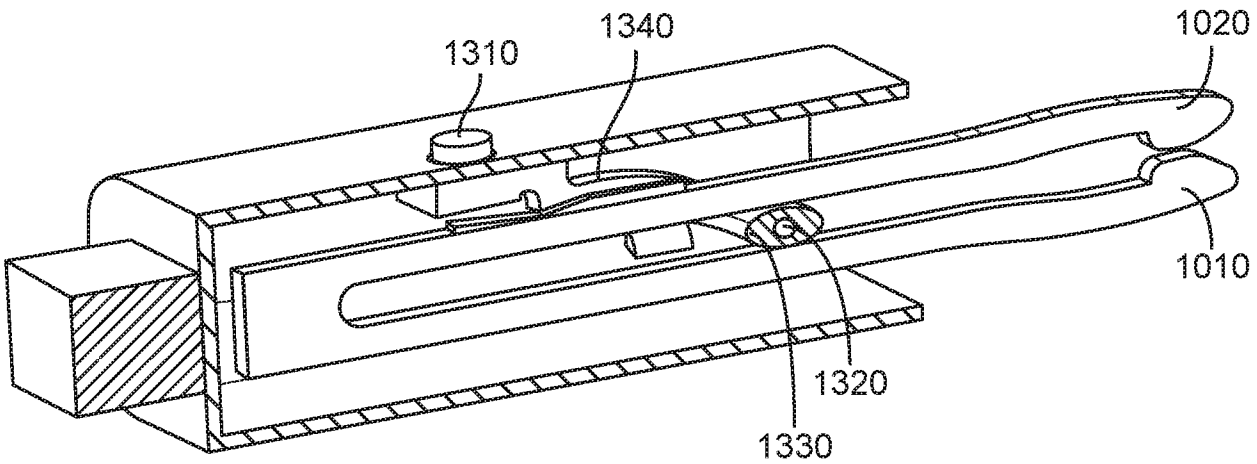
FIG. 13 illustrates an unlocking mechanism according to an embodiment of the present invention.

FIG. 13 illustrates an unlocking mechanism according to an embodiment of the present invention. Again, a side ground contact may include an upper rail 1020 and a lower rail 1010. An unlocking mechanism may be actuated by a user depressing button 1310. The depressing of this button may rotate an oblong portion 1330 about pivot point. 1320, thereby pushing the upper rail 1020 and lower rail 1010 away from each other.

Figure 14:
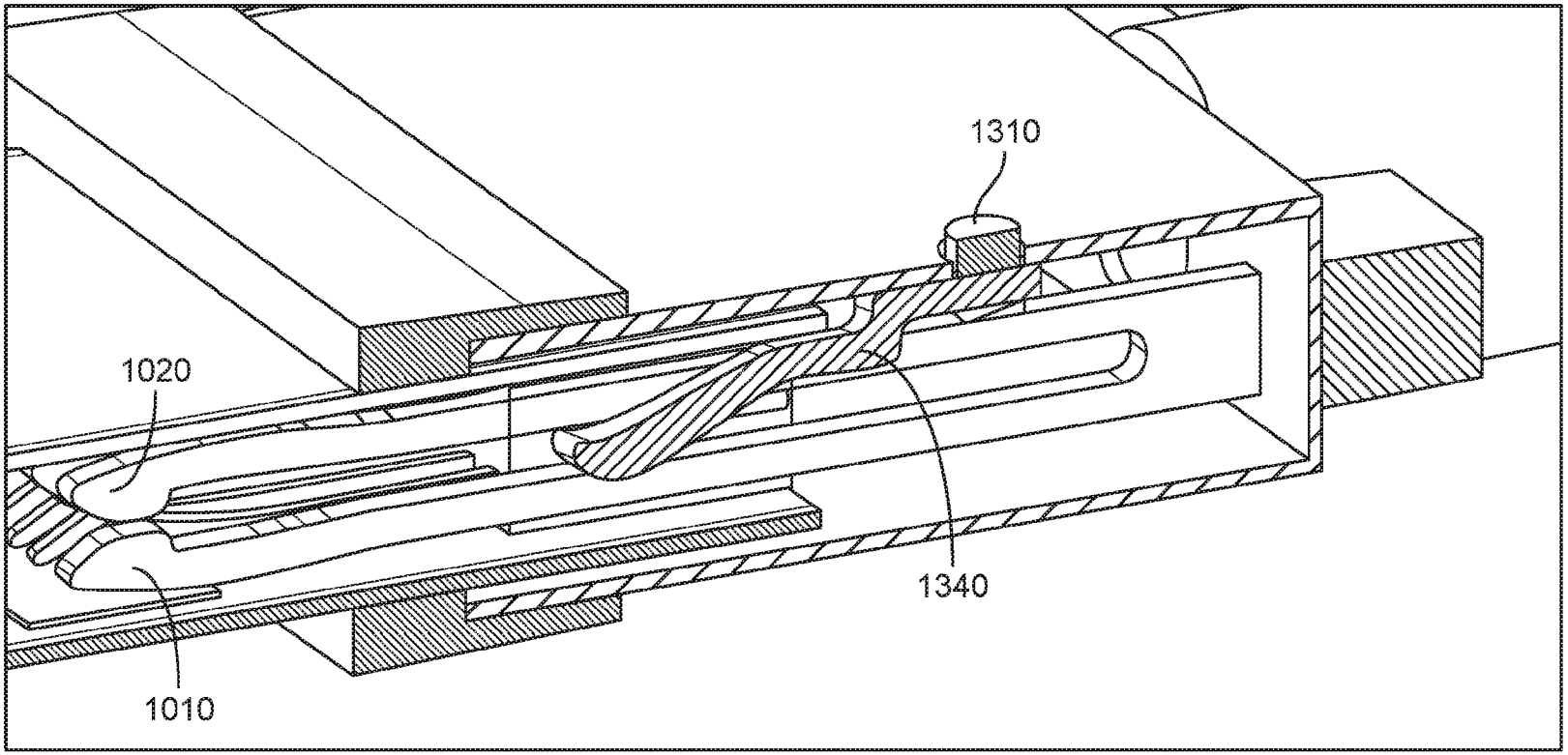
FIG. 14 illustrates a rear view of the unlocking mechanism of FIG. 13.

FIG. 14 illustrates a rear view of the unlocking mechanism of FIG. 13. Again, a user may depress button 1310, thereby lowering arm 1340. This may cause oblong portion 1330 to rotate, which may result in upper rail 1020 and lower rail 1010 being pushed away from each other.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A first connector comprising:

a plurality of contacts at least partially located in a housing; and a first side ground contact having an opening, a front leading edge of the side ground contact angled away from the plurality of contacts, and a tab at a front of the opening extending from the front of the opening towards a back of the side ground contact and angled monotonically away from the plurality of contacts, wherein the opening is arranged such that a first end of a wide portion of a tongue of a second connector fits in the opening when the second connector is mated with the first connector.

2. The connector of claim 1 further comprising:

a second side ground contact having an opening, a front leading edge of the side ground contact angled away from the plurality of contacts, and a tab at a front of the opening extending from the front of the opening towards a back of the side ground contact and angled monotonically away from the plurality of contacts, wherein the opening is arranged such that a second end of a wide portion of the tongue of the second connector fits in the opening when the second connector is mated with the first connector.

3. The connector of claim 2 wherein the first connector is a connector plug.

4. The connector of claim 2 wherein the first connector is a connector receptacle.

5. A first connector comprising:

a plurality of contacts at least partially located in a housing; and a first side ground contact having an opening, a front of the side ground contact angled away from the plurality of contacts, wherein the opening is arranged such that a first end of a wide portion of a tongue of a second connector fits in the opening when the second connector is mated with the first connector.

6. The connector of claim 5 further comprising a button that when actuated moves the opening in the first side ground contact away from the tongue.

7. The connector of claim 6 wherein the opening is located in a front portion of the first side ground contact, the button is in contact with a rear portion of the first side ground contact, and the first side ground contact pivots about a middle portion of the first side ground contact when the button is actuated.

8. The connector of claim 7 wherein the rear portion of the first side ground contact is folded back on itself to form a spring to push the opening in the first side ground contact towards the tongue when the button is not actuated.

9. The connector of claim 5 further comprising:

a second side ground contact having an opening, a front of the side ground contact angled away from the plurality of contacts, wherein the opening is arranged such that a second end of a wide portion of the tongue of the second connector fits in the opening when the second connector is mated with the first connector.

10. The connector of claim 9 wherein the first connector is a connector plug.

11. The connector of claim 9 wherein the first connector is a connector receptacle.

12. A first connector comprising:

a plurality of contacts at least partially located in a housing; and a first side ground contact comprising:

a first rail arranged to be positioned over a first end of a wide portion of a tongue of a second connector when the first connector and the second connector are mated, the first rail having a first contacting portion; and a second rail arranged to be positioned under the first end of the wide portion of a tongue of the second connector when the first connector and the second connector are mated, the second rail having a second contacting portion;

wherein the first contacting portion and the second contacting portion are arranged to hold the first wide end of the tongue of the second connector when the first connector and the second connector are mated.

13. The connector of claim 12 further comprising:

a second side ground contact comprising:

a first rail arranged to be positioned over a second end of a wide portion of a tongue of the second connector when the first connector and the second connector are mated, the first rail having a first contacting portion; and a second rail arranged to be positioned under the second end of the wide portion of a tongue of the second connector when the first connector and the second connector are mated, the second rail having a second contacting portion;

wherein the first contacting portion and the second contacting portion are arranged to hold the second wide end of the tongue of the second connector when the first connector and the second connector are mated.

14. The connector of claim 13 wherein the first connector is a connector plug.

15. The connector of claim 13 wherein the first connector is a connector receptacle.

16. The connector of claim 12 wherein the first contacting portion on the first rail forms a first wide portion near a front leading edge of the first rail.

17. The connector of claim 16 wherein the second contacting portion on the second rail forms a second wide portion near a front leading edge of the second rail, wherein the first wider portion and the second wider portion hold the first wide end of the tongue of the second connector when the first connector and the second connector are mated.

18. The connector of claim 12 further comprising an unlocking mechanism arranged to push the first rail away from the second rail as the first connector and the second connector are unmated.

19. The connector of claim 18 further comprising an actuated mechanism to drive the unlocking mechanism to push the first rail away from the second rail as the first connector and the second connector are unmated.

20. The connector of claim 19 wherein the actuated mechanism is a button that is actuated by a user as the first connector and the second connector are unmated.

21. The connector of claim 19 wherein the actuated mechanism is a button.

22. The connector of claim 21 wherein the unlocking mechanism is an oblong portion.

23. The connector of claim 22 wherein when the button is depressed, the unlocking mechanism rotates about a pivot point and the first rail is pushed away from the second rail.

* * * * *